US008152593B2

(12) United States Patent
Barton et al.

(10) Patent No.: US 8,152,593 B2
(45) Date of Patent: Apr. 10, 2012

(54) OPEN FRONT UNDERGARMENT AND METHOD OF MAKING THE SAME

(76) Inventors: Carol Barton, Los Angeles, CA (US); Anthony Clarke, Brooklyn, NY (US)

( * ) Notice: Subject to any disclaimer, the term of this patent is extended or adjusted under 35 U.S.C. 154(b) by 113 days.

(21) Appl. No.: 12/458,023

(22) Filed: Jun. 29, 2009

(65) Prior Publication Data

US 2010/0009598 A1 Jan. 14, 2010

Related U.S. Application Data

(60) Provisional application No. 61/129,458, filed on Jun. 27, 2008, provisional application No. 61/129,661, filed on Jul. 10, 2008.

(51) Int. Cl.
*A41C 3/00* (2006.01)

(52) U.S. Cl. ..... 450/88; 450/41; 450/80

(58) Field of Classification Search ..... 450/80, 450/88, 83, 41, 36–39, 54–58
See application file for complete search history.

(56) References Cited

U.S. PATENT DOCUMENTS 2,079,426 A * 5/1937 Schottenfels ..... 450/81
2,440,426 A * 4/1948 Barlow et al. ..... 450/47
2,472,280 A * 6/1949 Bruderlin ..... 450/80
2,472,281 A * 6/1949 Bruderlin ..... 450/80
2,482,953 A * 9/1949 Waters ..... 450/80
2,511,641 A * 6/1950 Kuhn ..... 450/39
2,553,241 A * 5/1951 Dache ..... 450/80
2,844,151 A * 7/1958 Lemons ..... 450/53
3,556,107 A * 1/1971 Brumfield ..... 450/41
5,334,082 A * 8/1994 Barker ..... 450/31
6,332,825 B1 * 12/2001 Henricksen ..... 450/81
7,422,508 B2 * 9/2008 Bentham ..... 450/86

* cited by examiner

*Primary Examiner* — Gloria Hale

(57) ABSTRACT

An open front undergarment having a form that allows the back of the garment to be closed and the front of the garment to be completely open and free from clasps, fabric or fasteners in the front between the cups. The open front undergarment includes a brassiere having an underwire and an overwire to form a frame, a rear band, a pair of cups extending from opposite ends of the rear band a cover material and a slip-resistant band. The underwire runs through the lower perimeter of a lower portion of the brassiere and the overwire runs through the upper perimeter. The underwire and overwire can be formed of a metal or a metal coated with plastic. The frame can also be formed of a single ductile member. The brassiere also includes a flexure region at the rear band to allow for flexure of the back and torso of the wearer.

20 Claims, 10 Drawing Sheets

OPEN FRONT UNDERGARMENT AND METHOD OF MAKING THE SAME

CROSS REFERENCE TO RELATED APPLICATIONS

The present application claims priority, under 35 U.S.C. §119(e), to U.S. Provisional Applications Nos. 61/129,458 filed Jun. 27, 2008, and 61/129,661 filed Jul. 10, 2008, both entitled "Open Front Undergarment and Method of Making the Same," each of which is herein incorporated by reference in its entirety.

BACKGROUND OF THE INVENTION

1. Field of the Invention

The present invention relates to an undergarment. More particularly, although not exclusively, the present invention relates to an open front undergarment or brassiere that partially circumscribes the body of a wearer. The present invention also relates to a method of manufacturing the undergarment.

2. Description of the Related Art

Undergarments such as brassieres come in a variety of styles. Two of the styles include the strapped and strapless brassieres. The strapped brassiere has two cups for breasts, a center panel or gore, a band for running around the torso under the bust, and a shoulder strap for each shoulder. The strapless brassiere has two cups for breasts, a center panel or gore and a band for running around the torso under the bust, but no shoulder straps. Other variations of the strapped and strapless brassieres include, for example, adhesive, shelf, convertible, cupless, balconette, full support, gel, and minimizer; however, the aforementioned brassieres either encircle the torso under the bust or fail to provide sufficient support members, such as for example, a support member across the back. Further, existing brassieres are usually fastened with a hook fastener on the band, typically at the back or in the front, between the cups. Other brassieres that encircle the torso are worn by being pulled on over the head and have no fasteners. There is a need for a brassiere that provides an opening in the front to accommodate clothes that are open in the front below the bustline, yet provides support to the breasts through the wearer's back.

SUMMARY OF THE INVENTION

The present invention relates to a new type of brassiere that is open in the front, whereby a supporting or rear band only partially circumscribes the torso of the wearer, and the cups are disposed at the ends of the rear band and separated from each other. The present invention takes into consideration that a wearer of the invention may be dressed in a garment that has a low front wherein the garment has an opening that extends below the bustline. The present invention also takes into consideration that the wearer desires a brassiere that provides both support from the back and an unobstructed space between the cups. The present invention further takes into consideration that a wearer of the invention may want to reduce the amount of material on the torso and in the breast area for ventilation between the breasts. As such, the brassiere of the present invention allows the wearer to cover and support the breast, so that the breast area can be ventilated and still supported, and that the wearer can wear clothing of a variety of styles.

One embodiment of the present invention includes a strapless brassiere having an open front. Another embodiment of the present invention includes a strapped brassiere having an open front and at least one shoulder strap that extends from the front to the back of the brassiere. A further embodiment of the present invention includes a variety of cup shapes for altering the appearance of the shape of the breasts, such as, for example, a pushed up shape for greater cleavage.

The brassiere of the present invention can also include a flexure region in the rear band. The flexure region can include a linkage or a hinge to facilitate dressing and allow flexure of the brassiere with the back of the wearer.

Example embodiments of the present invention will now be described in accordance with the above advantages. It will be appreciated that these examples are merely illustrative of the invention. Many variations and modifications will be apparent to those skilled in the art.

BRIEF DESCRIPTION OF THE DRAWINGS

The features of the invention will be more readily understood with reference to the following description and the attached drawings, wherein.

DETAILED DESCRIPTION OF INVENTION

Figure 1:
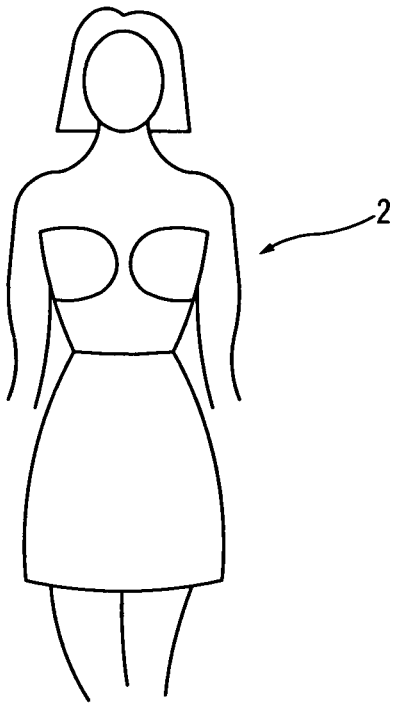
FIG. 1 illustrates a front view of a brassiere according to an embodiment of the present invention.
Figure 2:
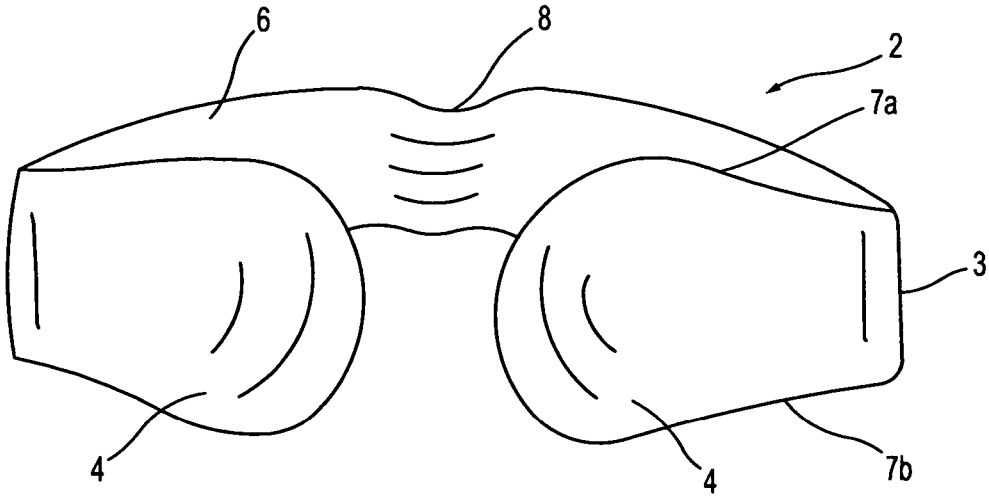
FIG. 2 illustrates a front perspective view of a brassiere according to an embodiment of the present invention.

FIGS. 1 to 8 illustrate and open front undergarment such as a brassiere 2 according to an embodiment of the present invention. The front view of the brassiere 2 shown in FIGS. 1 and 2 illustrates a pair of cups 4 extending from the ends of and supported by a rear band 6. The cups 4 directly support the breasts and the rear band 6 provides additional support to the cups and the overall brassiere 2. The cups can also conform to or are configurable to the shape of the wearer's breast. Further support can be provided by side portions of the frame which extend in a direction perpendicular to the longitudinal axis of the frame, as discussed below. The side portions of the frame can be integral with the frame or reinforced with added material. The cups 4 and rear band 6 are formed and reinforced by a frame 10, shown in FIG. 3, and a brassiere cover 3 is fixed to and extends over the entire frame.

Figure 14:
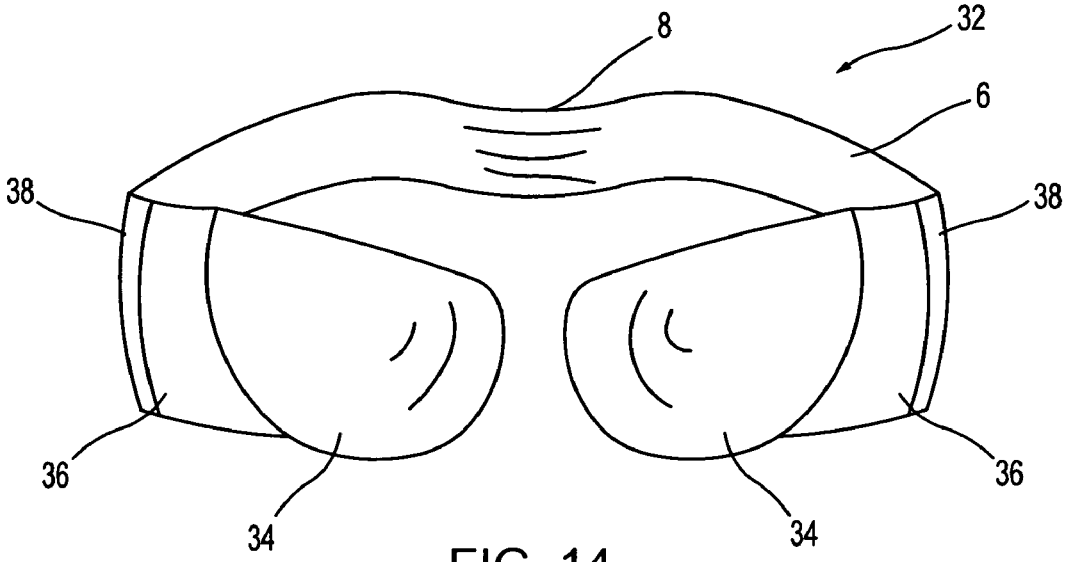
FIG. 14 illustrates a front perspective view of a brassiere according to a fifth embodiment of the present invention.
Figure 15:
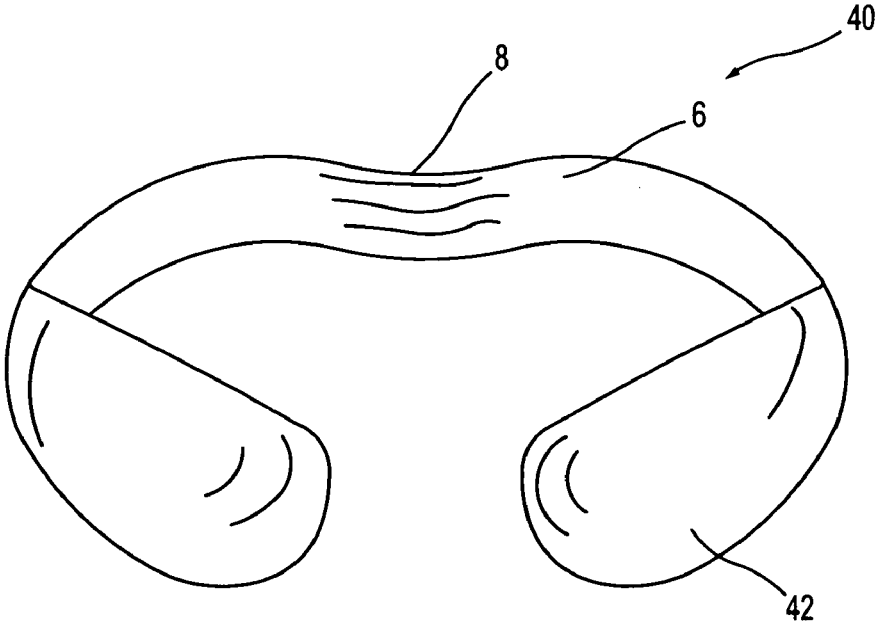
FIG. 15 illustrates a front perspective view of a brassiere according to a sixth embodiment of the present invention.

FIG. 2 shows the cups 4 extending from opposite ends of the rear band 6 and the frame being curved along a longitudinal axis thereof to form the brassiere as an arcuate member. A concave portion of the frame defines an inner surface thereof and a convex portion of the frame defines an outer surface. The inner surface of the frame facing an inner surface of the cups The cups 4 are separated from each other and are designed to be unconnected and independent of each other. The arrangement of the cups in the present invention allows an open front garment to be worn without the brassiere being seen. The cups 4, although shown as having a circular shape, can be formed in any shape including semicircular as shown in FIGS. 14 and 15, for example. The cups 4 enclose the breasts and provide a smooth line where the material at the upper edge of the cup ends.

The cover 3 can be formed from any material including, but not limited to fabrics such as cotton, polyester, spandex, lace, rayon, silk, or any combination thereof. For example, a combination may include natural and synthetic materials or stretch fabrics such as two-way stretch nylon/Lycra satin.

Figure 3:
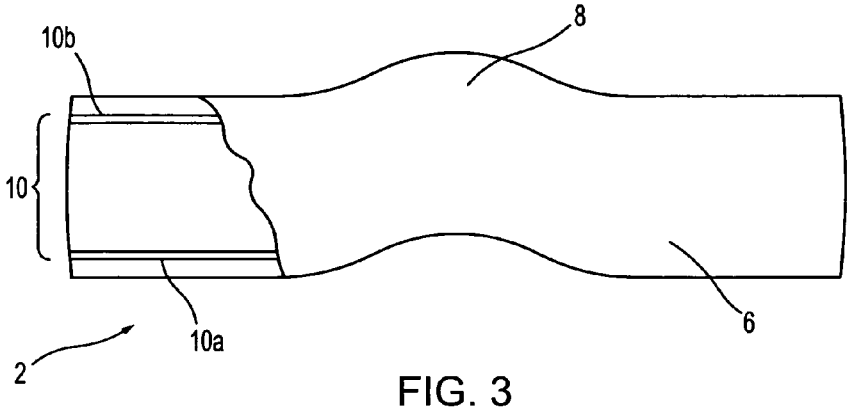
FIG. 3 illustrates a rear view of a brassiere according to an embodiment of the present invention.

The cover 3 of the present invention can be stretched over the frame 10 as shown in FIG. 3. The frame 10 is formed from an underwire 10*a* and an overwire 10*b*. The underwire 10*a* forms the lower portion of the brassiere 2 and the overwire 10*b* forms the upper portion. As such, the cups 4 and rear band 6 are bounded by the frame 10, which provides an outline of the brassiere. The frame 10 can be bent along its longitudinal axis to form an arcuate member that is contoured to the shape of a torso.

FIG. 3 shows the rear view of the brassiere 2, wherein the frame 10 is shown as curved along its longitudinal axis, at flexure region 8, from the outer surface to the inner surface of the brassiere. The flexure region 8 can be provided along a central portion of the rear band 6 to follow the curve of the wearer's back for a close and comfortable fit. The flexure region 8 allows the rear band 6 to flexibly move with the flexing of the wearer's back. Alternatively, the brassiere 2 can have a flexible frame that accommodates the natural flexure of the wearer across the upper torso above the bustline. Further, the flexure region 8 can be made of a material different from material of the underwire and overwire.

Figure 4:
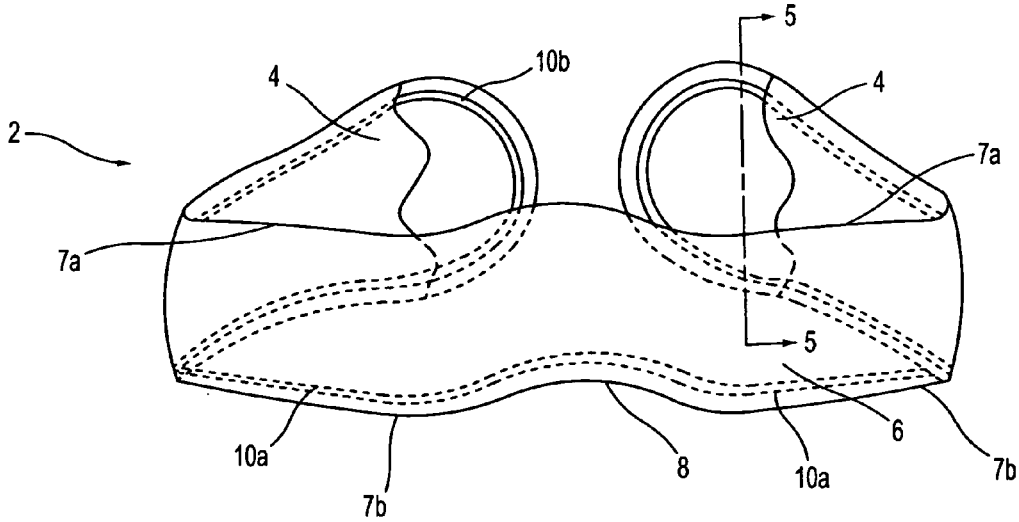
FIG. 4 illustrates a rear perspective view of a brassiere according to an embodiment of the present invention.

In FIG. 4, a cut-away portion of the brassiere 2 shows the interior of the cups 4 and the frame 10 including the underwire 10*a* and the overwire 10*b*. The underwire 10*a* is a rigid or semi-rigid band that runs along the lower perimeter or edge 7*b* of the brassiere 2 and forms the lower portion of the rear band 6 and the cups 4. The underwire 10*a* supports and uplifts the bustline. The overwire 10*b* is a rigid or semi-rigid band that runs along the upper perimeter or edge 7*a* of the brassiere 2 and forms the upper portion of the rear band 6 and cups 4 to provide a gripping force of the brassiere on the torso.

Figure 5:
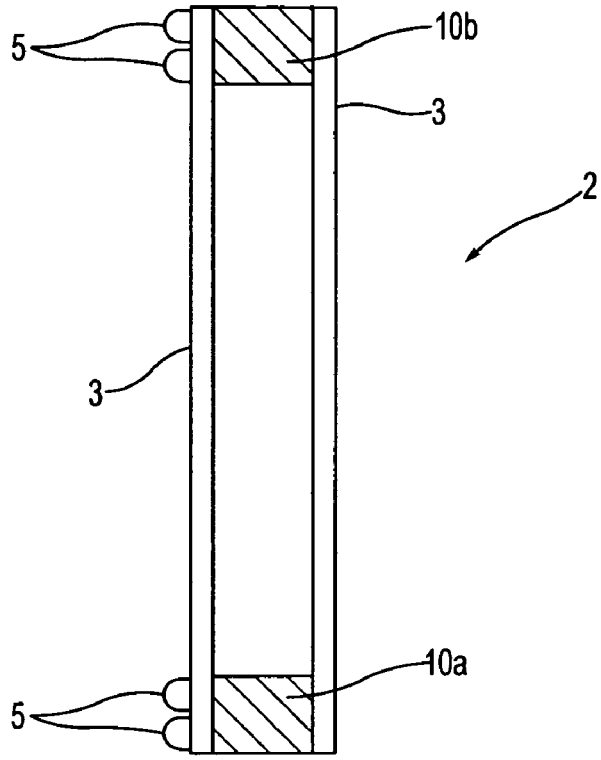
FIG. 5 illustrates a cross-sectional view of a brassiere according to an embodiment of the present invention.

FIG. 5 illustrates a cross-sectional area of the brassiere, through 5-5 in FIG. 4. The cross-sectional view shows the underwire 10*a* and overwire 10*b* of the frame 10 within the cover 3. The underwire 10*a* and overwire 10*b* are arranged along the perimeter of the cover 3 to shape the brassiere 2. The underwire 10*a* and overwire 10*b* can be secured into the cover 3 by an adhesive, sewing, a fastener or other securing means.

The underwire 10*a* and overwire 10*b* can be formed of a metal wire, such as a steel wire. The underwire and overwire are not limited to steel and can be formed of any elongated strand of drawn metal having ductility. In addition, the underwire and overwire can be formed of any metal wire coated with plastic. An alternative material for the underwire and overwire includes a polymeric material, such as plastic. The frame 10 is not limited to an overwire and underwire alone. The rear band 6 can also be made from a material different from that of the frame portion around the cups 4. For example, the rear band 6 can be made from elastic, rubber or other expandable material, while the cups 4 are made from the underwire and overwire. In addition, the rear band 6 can include a combination of the underwire and overwire and elastic, rubber or other expandable material. Materials in the present invention can be joined by adhesive, sewing, molding or other fastening and joining means.

The underwire 10*a* and overwire 10*b* can support the weight of the material used for forming the cover. Although the underwire 10*a* and overwire 10*b* are shown in the figures as having a rectangular cross section, the wires can have any cross section including oval or round, for example.

Figure 7:
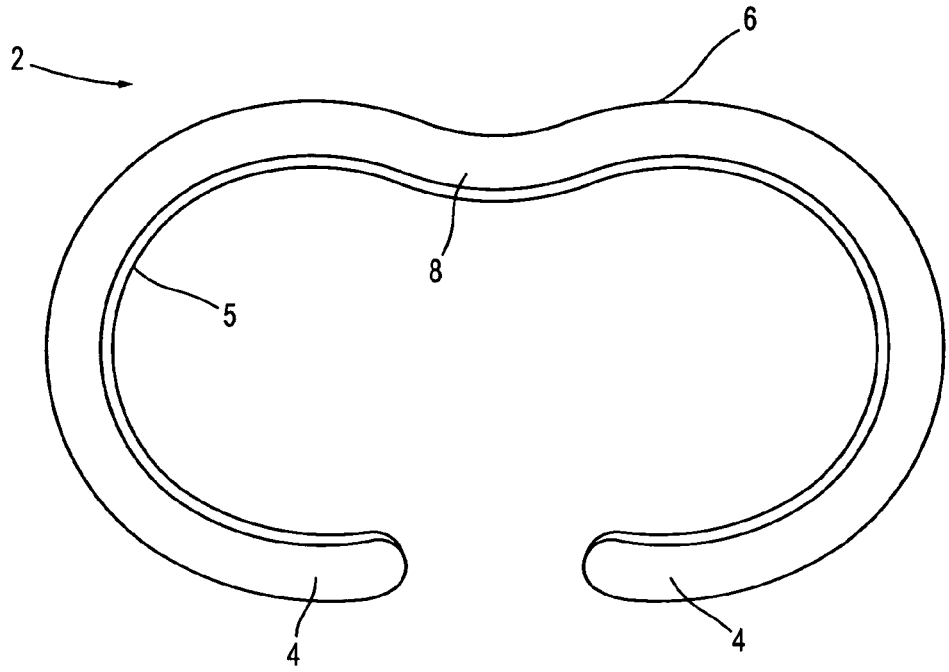
FIG. 7 illustrates a top view of a brassiere according to an embodiment of the present invention.
Figure 8:
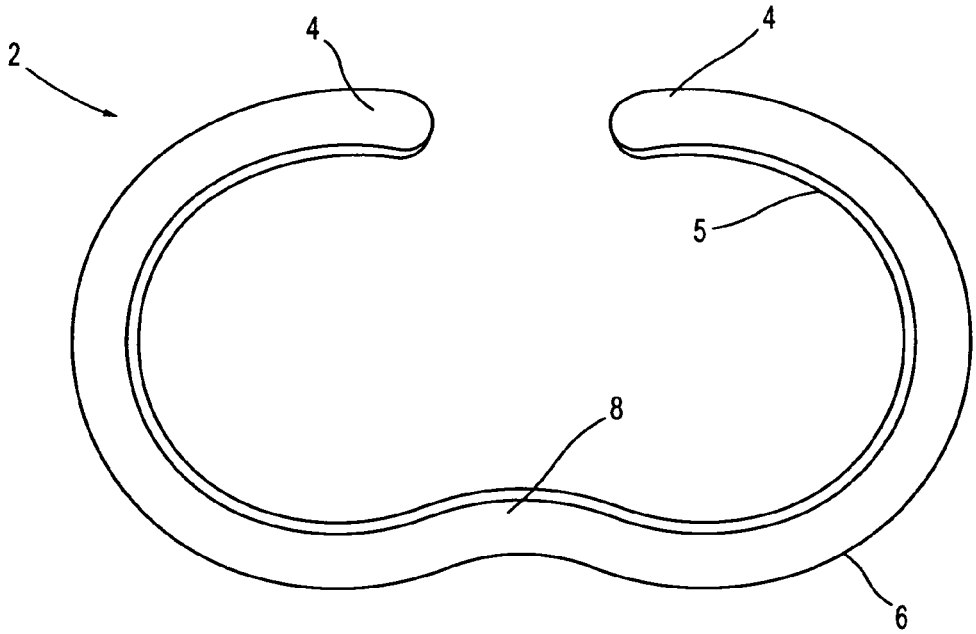
FIG. 8 illustrates a bottom view of a brassiere according to an embodiment of the present invention.

A slip-resistant band 5 shown in FIG. 5 can be affixed to the inner surface of the brassiere 2 on the cover 3 proximal to the upper and lower perimeters 7*a*, 7*b*. For example, as shown in FIG. 5, the slip-resistant band is shown as a continuous band on the inner surface of the rear band 6. The slip-resistant band can also extend around the cups as shown in FIGS. 7 and 8. The slip-resistant band 5 controls the position of the brassiere on the torso. The slip-resistant bands 5 can be formed from any material including, but not limited to, silicon, rubber or an adhesive. As shown in FIG. 5, a pair of slip resistant bands 5 can be located proximal to the outer edges of the brassiere. As an alternative to a continuous band, the slip resistant band can be segmented along the inner surface of the brassiere.

Figure 6:
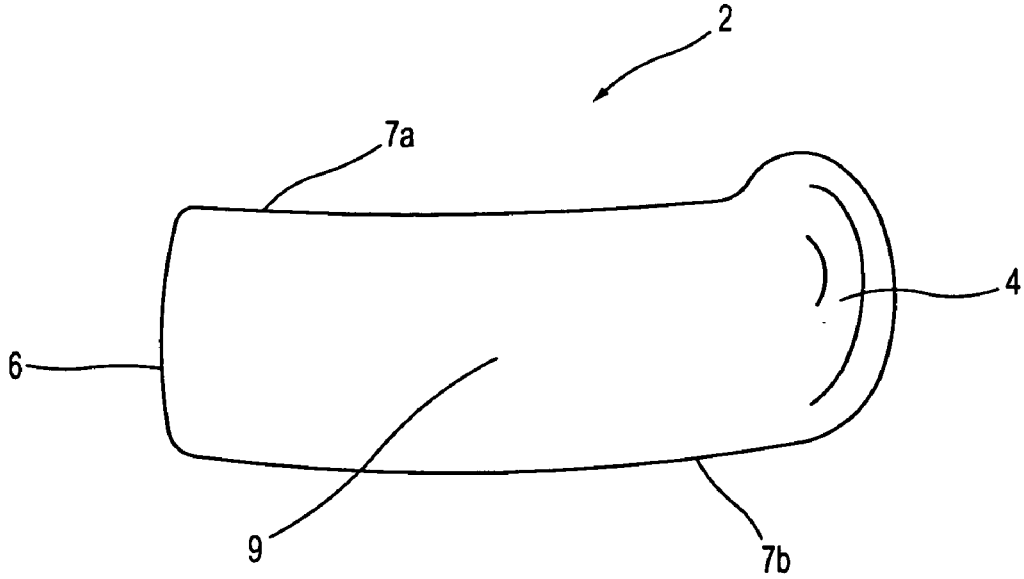
FIG. 6 illustrates a side view of a brassiere according to an embodiment of the present invention.

FIG. 6 illustrates a side view of the brassiere 2 according to an embodiment of the present invention. The sides 9 are uniform in height along the entire length of the brassiere 2 because the underwire 10*a* and the overwire 10*b* are equispaced throughout the rear band 6. The cups 4 can have a height that is greater than the height of the sides 9 and rear band 6. The lower perimeter 7*b* of the brassiere 2, as shown in FIG. 6, is parallel with the upper perimeter 7*a*. The side portion 9 of the brassiere can have the same height as the rear band 6 for uniformity of the frame 10 around the wearer's back. In order to maintain the uniformity, side portions can include reinforcing panels, such as reinforced fabric or wire that may be fitted to extend between the upper 7*a* and lower 7*b* perimeters of the brassiere anywhere along the length thereof. The reinforcing panels prevent the underwire 10*a* and overwire 10*b* from collapsing together.

In operation, the rear band 6 is designed to extend horizontally across the torso of the wearer along the wearer's back and partially around the front of the wearer so that the cups 4 remain separate and unconnected. The rear band 6, sides 9 and cups 4 can be held in place by the slip-resistant bands 5.

The brassiere 2 can have a shape that conforms to the torso of the wearer. For example, the shape of the brassiere can be oval, round, or rectangular as viewed from the top or bottom as shown in FIGS. 7 and 8. The frame 10 can be contoured toward the center of the brassiere so that the underwire 10*a* can apply pressure to the bustline for a snug fit. The flexure region 8 is shown as contoured toward the back of the wearer. The slip-resistant bands 5 are located on or adjacent to the inner surface upper and lower perimeters 7*a*, 7*b* of the brassiere to control the vertical and horizontal position of the brassiere on the torso.

Figure 9:
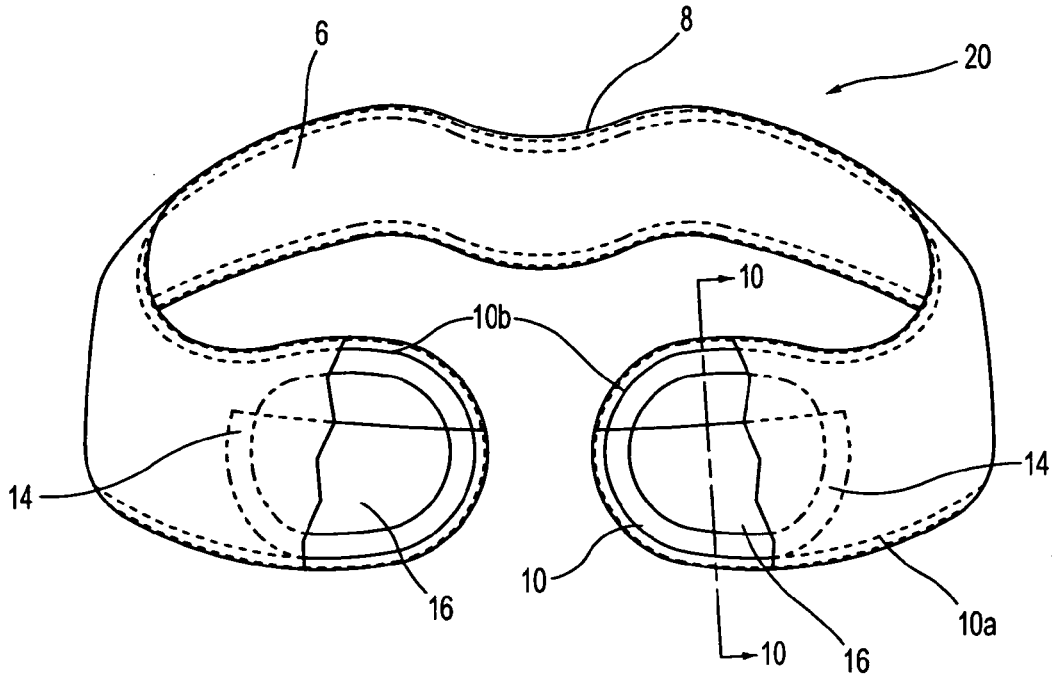
FIG. 9 illustrates a front perspective view of a brassiere according to a second embodiment of the present invention.
Figure 10:
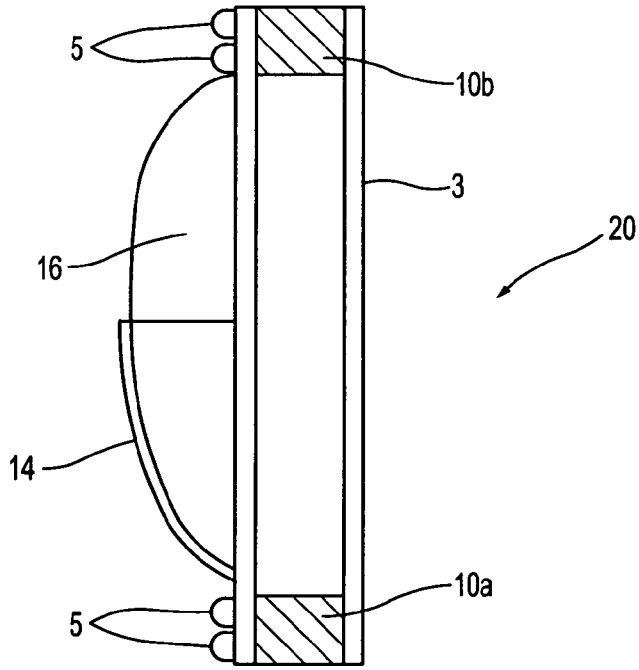
FIG. 10 illustrates a cross-sectional view of a brassiere according to the second embodiment of the present invention.

A second embodiment of the present invention shows a brassiere 20. In this embodiment, a padding 16 is disposed on an inner surface of the cups of the brassiere 20. The padding 16 can be formed from any material including cotton, fiberfill, silicone, sponge, gel or any other fill material. Further the padding 16 can be coated with an adhesive material on an outer surface thereof for adhering to the breasts. FIG. 9 illustrates a cut-away portion of the cups 4 showing the padding 16. FIGS. 9 and 10 illustrate a pocket 14 disposed on an inner surface of the cups 4 and the padding being disposed within the pocket 14. The padding 16 can be removably held in the pocket 14 having an open top, as shown in FIG. 10. The pocket 14 can be open at one end to allow the selective introduction of the padding 16. Alternatively, the padding 16 can be affixed to the inner surface of the cup 4 or fixed within the pocket 14 by means of sewing, an adhesive or other fastener. The pocket 14 can be connected to a lower portion of the cup 4, above the underwire 10*a*. Although the figures illustrate the pocket 14 as open at a top end, the pocket can be open at any end, such as a side or orthogonal end, to allow the padding 16 to be inserted into the cup 4. The pocket 14 is disposed between the slip-resistant bands 5 and the padding 16 can fit fully within the pocket or extend outward from a top of the pocket as shown in FIG. 10. The padding 16 serves to push the breast upward and create cleavage or to create a more curved silhouette in the area of the cups 4.

Figure 11:
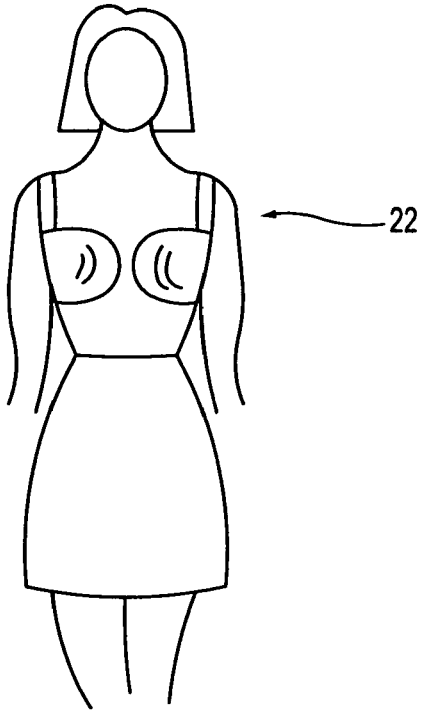
FIG. 11 illustrates a front view of a brassiere according to a third embodiment of the present invention
Figure 12:
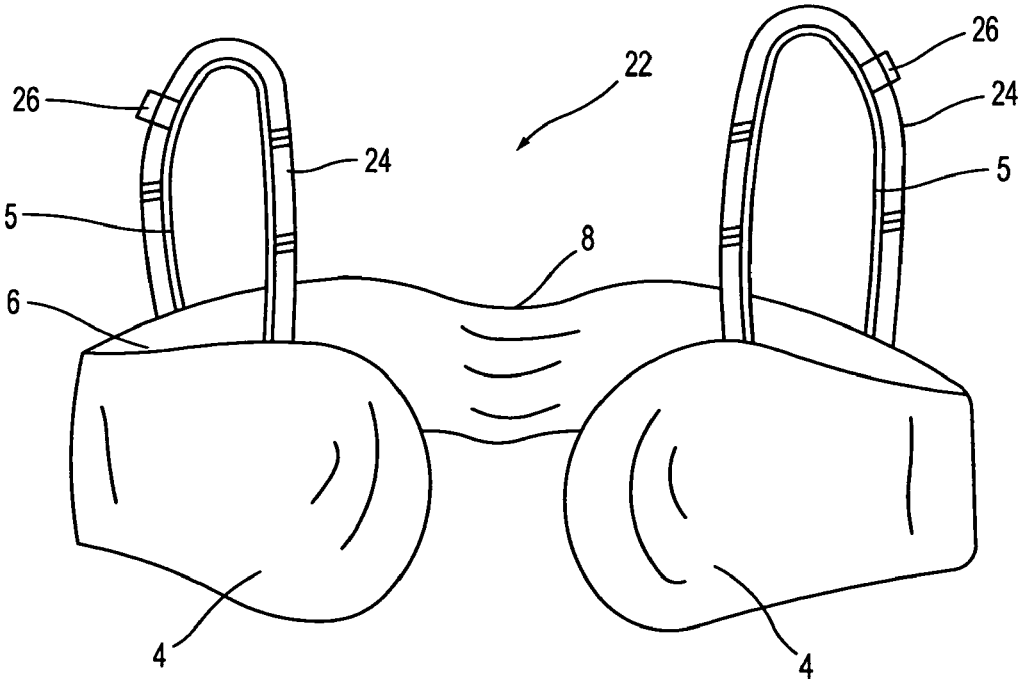
FIG. 12 illustrates a front perspective view of a brassiere according to the third embodiment of the present invention.

In a third embodiment of the present invention, an alternative brassiere 22 in FIGS. 11 and 12 is shown. The brassiere 22 is similar in structure to the brassieres 2 and 20 shown in FIGS. 2 and 9. The brassiere 22 can include shoulder straps 24 that extend from the rear band 6 to the cups at the open front. The shoulder straps 24 can be adjustable with adjusting members 26. The adjusting members 26 can include a buckle, Velcro® or other means for moving and securing the adjusting member along its length. The shoulder straps 24 can be made from materials such as elastic or a fabric such as cotton, and can be lined with slip-resistant bands 5 on an inner surface facing the cups 4 and rear band 6.

Figure 13:
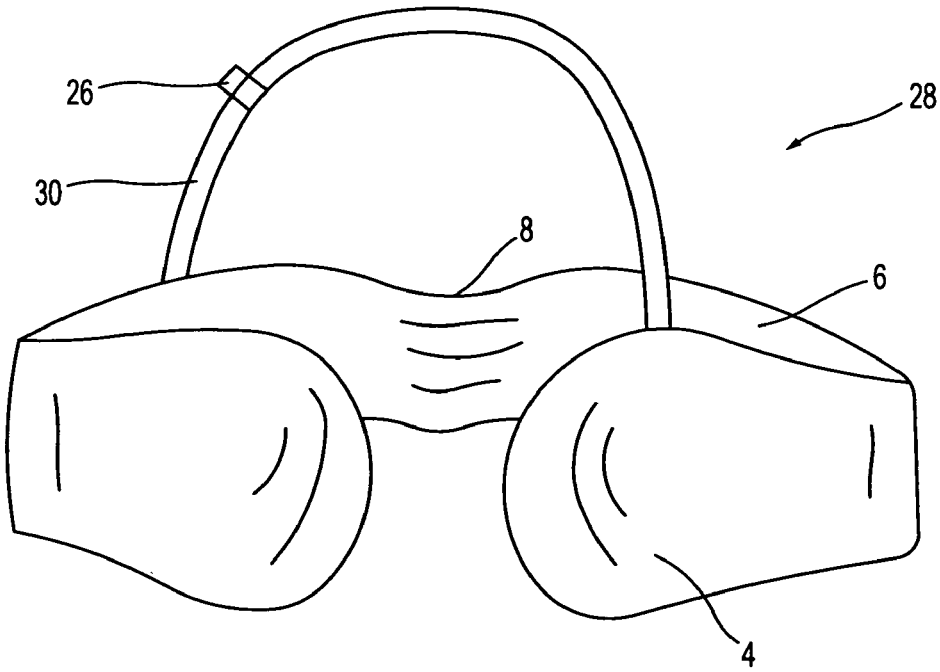
FIG. 13 illustrates a front perspective view of a brassiere according to a fourth embodiment of the present invention.

In a fourth embodiment of the present invention, an alternative brassiere 28 in FIG. 13 is shown. The brassiere 28 is similar in structure to the brassieres 2 and 20 shown in FIGS. 2 and 9. In this embodiment, a single shoulder strap 30 extends from one side of the rear band 6 of the brassiere 28 to a cup 4 on the front, diagonally across the arc formed by the curvature of the frame 10. The brassiere 28 can be worn under clothing styles such as halter tops or single shouldered tops to provide additional support to the cups 4. The shoulder strap 30 can be adjusted with an adjustment member 26.

In a fifth embodiment of the present invention, an alternative brassiere 32 in FIG. 14 is shown. The cups 34 of the brassiere 32 are in the form of semi-circles or demi-cups. The demi-cups shown in FIG. 14 allow low collar or low cut garments to be worn without the brassiere being seen. The demi-cups may be designed to provide lift, similar to a push-up brassiere. As such, the overwire can be omitted for additional lift.

For additional support in the brassiere 32 in FIG. 14, reinforcing members, such as a reinforcing panel 36 and reinforcing strip 38 can be added. The reinforcing panel 36 is located between the cups 4 and the rear band 6. The reinforcing strip 38 serves to keep the reinforced panel 36 in alignment with the rear band 6 and the cups 4. The reinforcing panel 36 can be made of elastic and the reinforcing strip 38 can be made of folded fabric to provide rigidity or a rigid plastic material, for example, covered with fabric.

A sixth embodiment of the present invention shown in FIG. 15 illustrates a brassiere 40. In the brassiere 40, the rear band 6 extends directly to the cups 42, which are designed as elongated demi-cups. As described above, the demi-cups allow low collar or low cut garments to be worn without the brassiere being seen and can provide lift, similar to a push-up brassiere. In order to increase the amount of lift, the overwire can be omitted.

Figure 16:
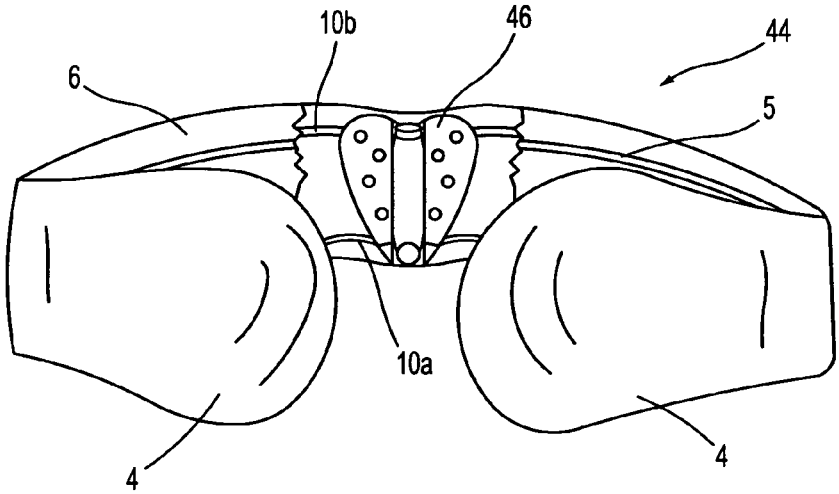
FIG. 16 illustrates a front perspective view of a brassiere according to a seventh embodiment of the present invention.
Figure 17:
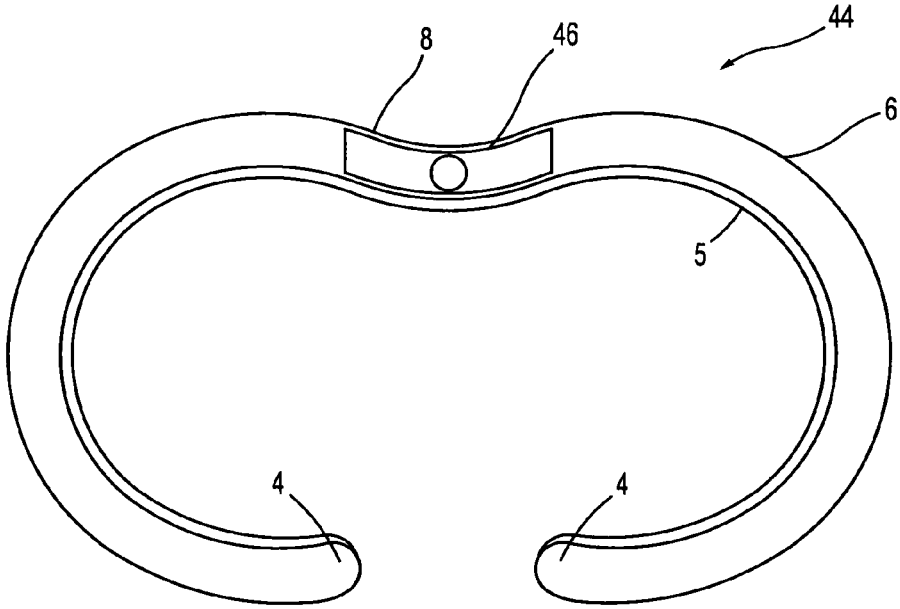
FIG. 17 illustrates a top view of a brassiere according to the seventh embodiment of the present invention.

FIGS. 16 and 17 illustrate a seventh embodiment of the present invention with a brassiere 44. Brassiere 44 is similar to the brassieres in FIGS. 1 to 13, in that it includes at least the flexure region 8 at the center of the rear band 6. For further flexing of the rear portion of the brassiere, a hinge 46 can be affixed to the center of the rear band 6. The hinge can be a butterfly hinge as shown, for example in FIGS. 16 and 17, or any pivoting member that allows for the flexure of the torso in a direction orthogonal to the longitudinal direction of the rear band 6.

Figure 18:
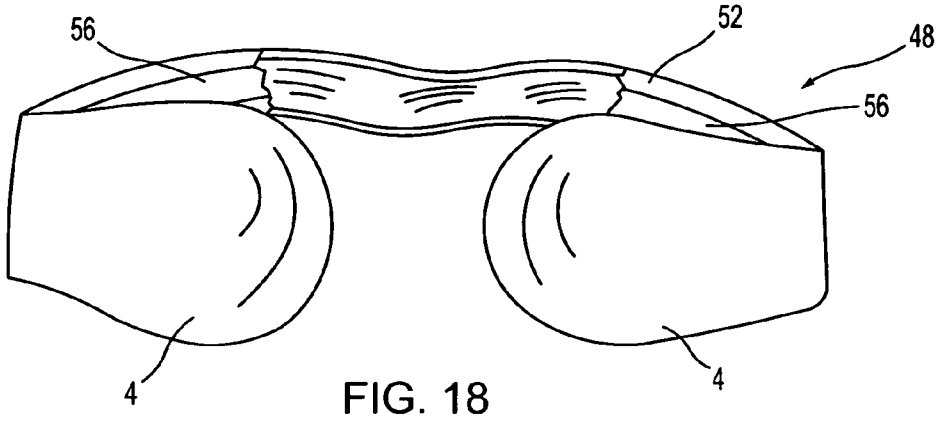
FIG. 18 illustrates a front perspective view of a brassiere according to an eighth embodiment of the present invention.
Figure 19:
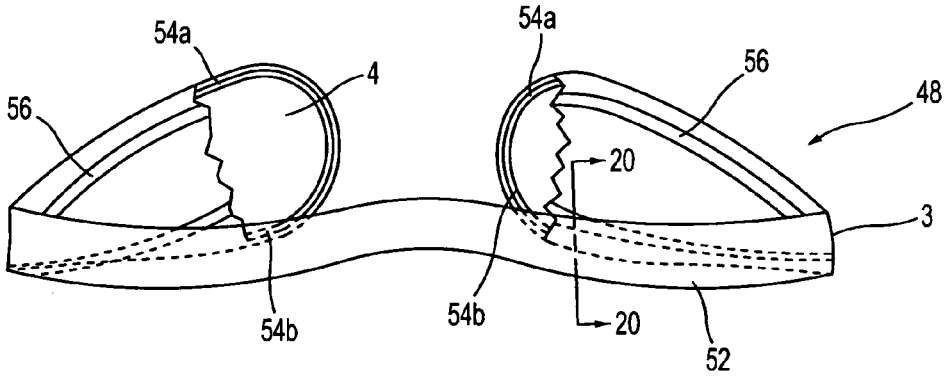
FIG. 19 illustrates a rear view of a brassiere according to the eighth embodiment of the present invention.
Figure 20:
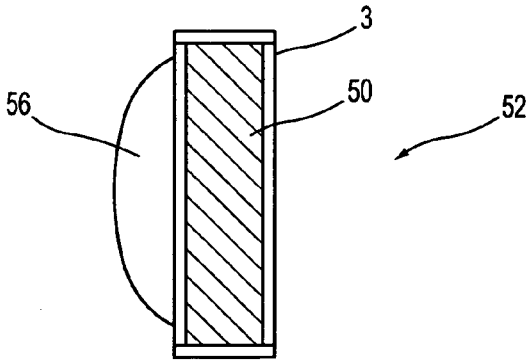
FIG. 20 illustrates a cross-sectional view of a brassiere according to the eighth embodiment of the present invention.

FIGS. 18, 19 and 20 illustrate an eighth embodiment of the present invention with a brassiere 48. As shown in FIG. 18, the brassiere 48 has a single or solo wire 50 provided in the rear band portion of the frame. The solo wire is a single wire that has a width that extends the entire width of the rear band 52, such that only a single band is need for support as opposed to the combined underwire and overwire. The solo wire supports the brassiere 48 in the rear band 52 across the wearer's back. The underwire 54*a* and overwire 54*b* remain around the cups 4 as shown in the cut-away view of FIG. 19. The solo wire 50 can be formed of a metal wire, such as a steel wire. The solo wire 50 is not limited to steel and can be formed of any elongated strand of drawn metal having ductility. In addition, the solo wire 50 can be formed of any metal wire coated with plastic. An alternative material for the solo wire 50 includes a polymeric material, such as plastic. The plastic can be injection molded to form the rear band 52 and the underwire 54*a* and overwire 54*b*. The solo wire 50 can support the weight of the material used for forming the cover 3. Although the solo wire 50 is shown in the figures as having a rectangular cross section, the wires can have any cross section including, for example, oval or rounded. A further alternative material within the rear band 52 can be elastic, rubber or other expandable material, while the cups 4 are made from the underwire and overwire. In addition, the rear band 52 can include a combination of the solo wire 50 and elastic, rubber or other expandable material. Materials in the present invention can be joined by adhesive, sewing, molding or other fastening and joining means.

A slip-resistant band 56 shown in FIGS. 18 and 20 can be affixed to the inner surface of the rear band 52 on the cover 3 of the brassiere 2. The slip-resistant band 5 controls the position of the brassiere on the torso. The slip-resistant bands 5 can be formed from any material including, but not limited to, silicon, rubber or an adhesive. As shown in FIG. 19, a slip resistant band 56 is located proximal to the outer edges of the cups 4 of the brassiere 48.

Although the solo band and underwire and overwire are described above, the present invention contemplates any number of underwire, overwire through the band to provide support to the overall brassiere.

The present invention as shown FIGS. 1 to 17 can be constructed by forming the brassiere frame 10 from the underwire 10*a* and the overwire 10*b*. The cups can be formed in the brassiere by any mechanical or electro-mechanical device for shaping and/or molding an underwire for a brassiere. The underwire 10*a* and overwire 10*b* can be formed from metal or a metal coated with plastic or another rigid, semi-rigid and formable material. The cover 3 can then be formed over the frame 10 or, alternatively, the frame can be formed and the underwire 10*a* and overwire 10*b* can be passed through a hem at the upper and lower perimeters 7*a*, 7*b* of the brassiere 2. The slip resistant band or bands 5 can be affixed to the inner surfaces of the upper and lower perimeters 7*a*, 7*b* of the cover 3 to control the movement of the brassiere on the torso of the wearer. In alternative embodiments of the present invention, shoulder straps can be fastened to the rear and front of the brassiere to further support the cups 4.

The present invention as shown in FIGS. 18 to 20 can be constructed by injection molding the rear band 50 with the underwire 54*a* and overwire 54*b*. The cover material 3 can be formed around the frame and a slip-resistant band 56 can be affixed to the inner surface of the rear band 52 and around the perimeter of the cups 4.

The underwire and overwire of the present invention can be joined by adhesive, sewing, molding or other fastening and joining means.

Example embodiments of the present invention have now been described in accordance with the above advantages. It will be appreciated that these examples are merely illustrative of the invention. Many variations and modifications will be apparent to those skilled in the art.

We claim:

1. An open front undergarment comprising:

a frame having a longitudinal axis and formed as an arcuate body, the frame comprising an underwire forming a first edge of the frame and an overwire forming a second opposite edge of the frame;

a pair of cups with each cup disposed at opposite longitudinal ends of the frame;

a rear band portion disposed on the frame between the pair of cups;

a cover fixed to and covering the frame and the pair of cups; and a pair of reinforcing members arranged between each of the pair of cups and the rear band.

2. The open front undergarment according to claim 1, wherein the pair of cups are formed by the frame.

3. The open front undergarment according to claim 1, wherein a concave portion of the frame defines an inner surface thereof and a convex portion of the frame defines an outer surface, the cups having an inner surface facing the convex portion and inner surface of the frame.

4. The open front undergarment according to claim 3, further comprising a slip resistant band fixed to the cover on an inner surface of the frame.

5. The open front undergarment according to claim 3, further comprising a pocket disposed on the cover on an inner surface of each of the cups.

6. The open front undergarment according to claim 5, wherein padding is provided in the pocket, the padding formed from at least one of fiberfill, silicone, sponge, and gel.

7. The open front undergarment according to claim 1, wherein the frame comprises a flexure region at a central portion thereof.

8. The open front undergarment according to claim 1, wherein the frame is formed from one of steel, a drawn metal having ductility, a metal wire coated with plastic, and a polymeric material.

9. The open front undergarment according to claim 1, wherein frame portion between the cups defines the rear band, the rear band further comprising a material formed from at least one of elastic, rubber and an expandable material.

10. An open front undergarment comprising:

an arcuate frame formed from a single elongated support member, the support member defining outer perimeters and a width of the arcuate frame, the arcuate frame having a concave portion defining an inner surface thereof and a convex portion detining an outer surface;

a pair of cups with each cup connected to the frame at the opposite ends thereof and facing the inner surface of the frame;

a cover fixed to and covering the arcuate frame and the pair of cups, and a pivoting member disposed centrally between the pair of cups along a rear portion of the arcuate frame.

11. The open front undergarment according to claim 10, wherein the arcuate frame is formed from one of steel, an elongated strand of drawn metal having ductility, a metal wire coated with plastic and a polymeric material.

12. The open front undergarment according to claim 10, wherein the pair of cups are formed by a wire into one of a rounded, semi circular or demi-circular shape.

13. The open front undergarment according to claim 10, further comprising a slip resistant band fixed to the cover on an inner surface of the arcuate frame.

14. A method of making an open front undergarment comprising:

arranging an elongated underwire and overwire in parallel;

joining adjacent ends of the parallely arranged underwire and overwire to form a frame;

shaping the ends of the frame, where the underwire and overwire are joined, into the form of cups configurable to the shape of a wearer's breast;

curving the frame along a longitudinal axis thereof to arrange the cups adjacent to each other, leaving a space in between;

inserting a pair of reinforcing members along the frame between and adjacent to each of the cups and attaching the pair of reinforcing members to the underwire and overwire; and covering the frame and the cups with a covering material.

15. The method according to claim 14, wherein the step of curving the frame comprises bending the frame to form an arcuate body.

16. The method according to claim 14, wherein the step of covering the frame comprises covering the frame with a material formed from at least one of a natural and synthetic material.

17. The method according to claim 16, wherein the step of covering the frame comprising covering the frame with two-way stretch nylon.

18. The open front undergarment according to claim 10, wherein the pivoting member comprises a butterfly hinge.

19. The open front undergarment according to claim 1, wherein each pair of reinforcing members comprises a reinforcing panel and a reinforcing strip, the reinforcing panel being made of elastic and the reinforcing strip being made of folded fabric.

20. The open front undergarment according to claim 19, wherein each reinforcing panel is located between the reinforcing strip and each cup.

* * * * *